United States Patent [19]

Pacca

[11] Patent Number: 4,793,114

[45] Date of Patent: Dec. 27, 1988

[54] WINDOW SILL CONSTRUCTION

[76] Inventor: Stephen R. Pacca, 150 Overlook Ave., Apt. 15F, Hackensack, N.J. 07601

[21] Appl. No.: 40,819

[22] Filed: Apr. 21, 1987

[51] Int. Cl.[4] ..... E06B 3/30

[52] U.S. Cl. ..... 52/738; 52/211

[58] Field of Search ..... D25/74; 52/211, 212, 52/213, 214, 215, 216, 217, 204, 397, 398, 235, 97, 727, 738; 49/DIG. 1, DIG. 2, 504, 505

[56] References Cited

U.S. PATENT DOCUMENTS

| | | | |
|---|---|---|---|
| D 285,610 | 9/1986 | Slocomb, Jr. . | |
| 2,733,787 | 2/1956 | Morra | 52/97 |
| 2,835,360 | 5/1958 | Bernardoni | 49/DIG. 1 |
| 3,694,961 | 10/1972 | Johnson | 49/504 |
| 3,859,754 | 1/1975 | Budich | 49/504 |
| 4,151,682 | 5/1979 | Schmidt | 49/404 |
| 4,154,028 | 5/1979 | Spaulding | 52/97 |
| 4,251,964 | 2/1981 | Francis | 52/235 |
| 4,304,081 | 12/1981 | Dawson | 49/DIG. 1 |
| 4,328,644 | 5/1982 | Scott | 52/727 |
| 4,674,246 | 6/1987 | Giguere | 49/404 |

FOREIGN PATENT DOCUMENTS

| | | | |
|---|---|---|---|
| 2215244 | 11/1972 | Fed. Rep. of Germany | 49/404 |
| 1526933 | 4/1968 | France | 52/97 |

*Primary Examiner*—John E. Murtagh
*Attorney, Agent, or Firm*—Charles E. Baxley

[57] ABSTRACT

A sill member for a replacement window is fabricated from an extrusion of plastic material and includes a first wall portion having a first inner face, a second wall portion having a second inner face, the first and second inner faces being placeable on the indoor and outdoor sides, respectively, of a window opening, and a solid main floor portion integrally joining the wall portions and having upper and lower planar parallel faces. The upper face of the main floor portion intersects the first inner face at an angle of about 93°. The second wall portion has an outer planar face parallel to the second inner face, the upper face of the main floor portion intersects the outer face of the second wall portion in an edge line, and the upper face of the main floor portion extends uninterruptedly to the edge line, to provide uninterrupted drainage of about 3° from the first wall portion to the edge line. An additional floor portion and a ceiling portion project from the second wall portion way from the first wall portion and provide, together with the second wall portion, a longitudinal casing slot for sealingly receiving a casing therein.

2 Claims, 1 Drawing Sheet

WINDOW SILL CONSTRUCTION

RELATED APPLICATIONS

This application is related to U.S. patent applications Ser. Nos. 040,028, now U.S. Pat. No. 4,753,056, 040,034, now U.S. Pat. No. 4,742,647 and 040,283, each of which was filed Apr. 20, 1987 in the name of the present inventor.

BACKGROUND OF THE INVENTION

This invention relates to window sill construction and more particularly to a window sill member for a replacement window.

Still more particularly, the invention relates to such a sill member which is fabricated from an extrusion of plastic material, having several advantages over the prior art, as typified by U.S. Design Pat. No. 285,610, which issued to Leon F. Slocomb, Jr. on Sept. 9, 1986, entitled "Window Sill Extrusion". The window sill extrusion of the design patent is of uniform cross sectional thickness and features a double wall construction for attaining sufficient strength. In addition, the extrusion of the design patent presents a sloped surface on the outer half but a horizontal surface on the inner half, with a step between the two halves, a condition not conducive to positive drainage.

It is an important object of the present invention to provide an improved window sill member for a replacement window, the improved member requiring less material than prior window sill members and hence being less costly, this object being obtained by thickening portions of the extrusion for the window sill member, thereby eliminating the need for double walls.

Another important object is to provide an improved window sill member with a sloped portion for positive drainage all the way from the inside to the outside of the window.

In the installation of prior art sills, it is common practice to butt a casing against the sill, thereby creating a joint which can cause a leak.

Accordingly, a further important object is to provide a sill member that has a casing slot for sealingly receiving a casing therein to form a leakproof joint.

Other objects and advantages will appear hereinafter.

SUMMARY OF THE INVENTION

A sill member for a replacement window embodying the present invention is fabricated from an extrusion of plastic material and includes a first wall portion having a first inner face, a second wall portion having a second inner face, the first and second inner faces being placeable on the indoor and outdoor sides respectively, of a window opening, and a solid main floor portion integrally joining the wall portions and having upper and lower planar parallel faces. The upper face of the main floor portion intersects the first inner face at an angle of about 93°. The second wall portion has an outer planar face parallel to the second inner face, the upper face of the main floor portion intersects an edge line, and the upper face of the main floor portion extends uninterruptedly to the edge line, to provide uninterrupted drainage of about 3° from the first wall portion to the edge line. An additional floor portion and a ceiling portion project from the second wall portion away from the first wall portion and provide, together with the second wall portion, a longitudinal casing slot for sealingly receiving a casing therein.

DESCRIPTION OF THE INVENTION

Figure 1:
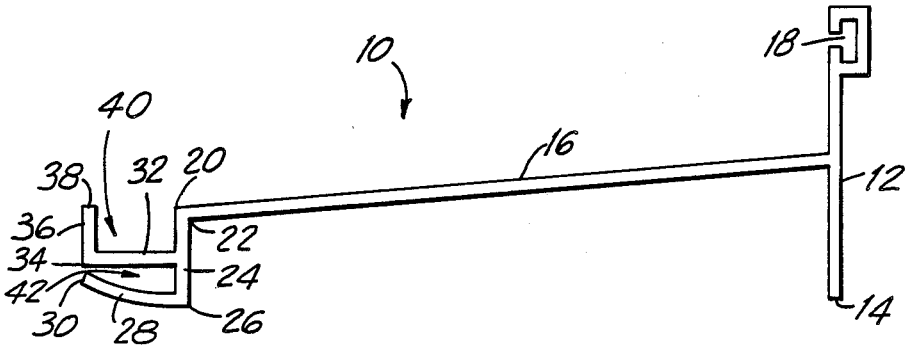
FIG. 1 is an end view of an extrusion for a preferred window sill member embodying the invention.

A preferred window sill member embodying the invention may be fabricated by cutting to desired length an extrusion of plastic material, a suitable example of which is polyvinyl chloride (PVC). The extrusion or sill member is indicated in end view at 10 in FIG. 1 in the as extruded condition.

Sill member 10 has a vertical wall portion 12 about 0.093 inch (0.24 cm) thick with inner and outer planar parallel faces and a free bottom edge 14. A main floor portion 16 has a thickness of about 0.093 inch (0.24 cm) between upper and lower planar parallel faces and the line of juncture of the upper face of portion 16 with the inner face of wall portion 12 is located about 0.687 inch (1.74 cm) above bottom edge 14. Floor portion 16 is not perpendicular to wall portion 12, but makes an obtuse angle of about 93° with the part of the inner face of wall portion 12 above the juncture of portions 12 and 16, providing sill member 10 with a 3° slope for positive drainage away from that juncture.

Integral with the top of wall portion 12 is a channel portion 18 providing a channel for reception of a sealing element (not shown) to provide sealing engagement with an inner sash (not shown) when the latter is in the closed (down) position. The wall thickness of sill member 10 in channel portion 18 is about 0.06 inch (0.15 cm) and the height of wall portion 12 from bottom edge 14 to channel portion 18 is about 1.107 inches (2.81 cm), channel portion 18 extending upwardly about 0.33 inch (0.84 cm) above the top of wall portion 12.

The upper face of floor portion 16 terminates in an edge line 20 parallel to the inner face of flange portion 12 and spaced about 3.25 inches (8.26 cm) therefrom, and the lower face of floor portion 16 terminates in an edge line 22 parallel to the inner face of wall portion 12 and spaced about 3.19 inches (8.10 cm) therefrom.

Depending from edges 20 and 22, sill member 10 has a wall portion 24 about 0.06 inch (0.15 cm) thick between inner and outer planar parallel faces, the former terminating in a bottom edge line 26 parallel to the inner face of wall portion 12 and coplanar with bottom edge 14 thereof. Wall portion 24 is parallel to wall portion 12.

Projecting from wall portion 24 in the direction away from wall portion 12 is an additional floor portion 28 having a thickness of about 0.06 inch (0.15 cm) between upper and lower faces, this lower face intersecting edge line 26. Floor portion 28 terminates in a free edge 30.

Projecting from the outer face of wall portion 24 in the direction away from wall portion 12 is a ceiling portion 32 having lower and upper parallel faces perpendicular to the outer face of wall portion 24. Ceiling portion 32 has a thickness between its lower and upper faces of about 0.06 inch (0.15 cm), the lower face of ceiling portion 32 terminating in an edge line 34 about 0.44 inch (1.12 cm) from the outer face of wall portion 24 and parallel thereto.

Projecting from ceiling portion 32 in the direction away from floor portion 28 is a wall portion 36 having a thickness of about 0.06 inch (0.15 cm) between inner and outer parallel faces perpendicular to the lower and upper faces of ceiling portion 32, the outer face of wall portion 36 terminating at edge line 34. Wall portion 36 terminates at a free upper edge 38 coplanar with the upper face of floor portion 16. The outer face of wall portion 24 and the inner face of wall portion 36 are parallel and spaced about 0.38 inch (0.97 cm) from each other. The outer face of wall portion 24, the inner face of wall portion 36 and the upper face of ceiling portion 32 provide sill member 10 with a longitudinal channel 40 for reception of a screen (not shown) therein.

Figure 2:
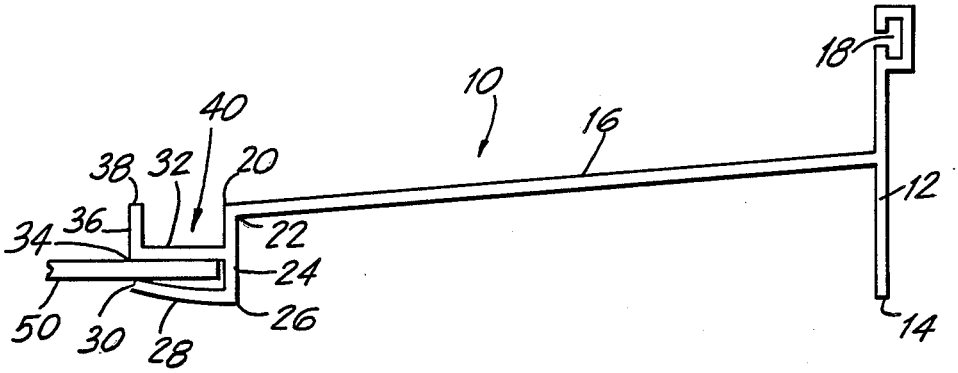
FIG. 2 is a view similar to FIG. 1, also showing fragmentarily a window casing assembled with the extrusion of FIG. 1.

Floor portion 28 is shown curved an FIGS. 1 and 2, more severely so in FIG. 1. The material (PVC) of sill member 10 is somewhat flexible, so that floor portion 28 is subject to resilient flexure, for a purpose to be brought out. If it be assumed that floor portion 28 were not curved, so that its upper and lower faces are planar and perpendicular to the faces of wall portion 24, edge 30 of floor portion 28 would be coplanar with the outer face of wall portion 36, and the distance between the lower face of ceiling portion 32 and the upper face of floor portion 28 would be about 0.125 inch (0.32 cm).

The outer face of wall portion 24, the upper face of floor portion 28 and the lower face of ceiling portion 32 provide sill member 10 with a casing slot 42 extending longitudinally of sill member 10 that, as extruded, is almost closed at free edge 30. Casing slot 42 has a nominal depth of about 0.44 inch (1.12 cm).

FIG. 2 shows a casing 50 inserted in casing slot 42. Casing 50 may be fabricated of an aluminum sheet that is 0.019 inch (0.048 cm) thick that has been slid into slot 42, expanding the same by resiliently flexing floor portion 28 away from ceiling portion 32 to create with casing 50 a positive seal against air and water infiltration, without caulking.

A replacement window incorporating sill member 10 is installed an a window opening (not shown) with wall portion 12 on the indoor side of the window opening and wall portion 24 on the outdoor side of the opening.

It is common in installing replacement windows to butt the casing against the replacement sill thereby creating a joint that can cause a leak. The provision of casing slot 42 in sill member 12 overcomes this defect of the prior art.

Furthermore, floor portion 16 is sloped at 3° in uninterrupted fashion all the way from wall portion 12 to edge line 20, whereby uninterrupted positive drainage is provided.

In addition, because of the 0.093 inch (0.24 cm) thick construction of wall portion 12 and floor portion 16, double wall sill construction that is common in the prior art is eliminated, thus resulting in a material, weight and cost saving. Sill member 10, as described, weighs only about 0.305 pound per foot (4.54 grams/cm), which presents a substantial saving in weight and cost.

Sill member 10 can be incorporated in a wide variety of replacement windows.

The invention well attains the stated objects and advantages and others.

The disclosed details are exemplary only and are not to be taken as limitations on the invention except as those details are included in the appended claims.

What is claimed is:

1. A sill member for a replacement window, said sill member fabricated by cutting an extrusion of plastic material to desired length, said sill member comprising a first wall portion having a first planar inner face, a second wall portion having a second planar inner face confronting and parallel to said first inner face, said face and second inner faces placeable on an indoor side and an outdoor side respectively of a window opening, and a main floor portion integrally joining said wall portions and having upper and lower parallel planar faces intersecting said first inner face at locations such that said first wall portion extends above and below said floor portion, said upper face of said floor portion intersecting said first inner face at an obtuse angle and said lower face of said floor portion intersecting said first inner face at an acute angle supplementary to said obtuse angle, said additional floor portion and said ceiling portion are formed so that said casing slot is widest at the juncture of said additional floor portion and said ceiling portion with said second wall portion and said additional floor portion and said ceiling portion being capable of relative resilient flexure away from each other to increase effective width of said casing slot.

2. A sill member according to claim 1 wherein the distance between said upper face of said additional floor portion and said lower face of said ceiling portion at said junctures is about 0.125 inch (0.32 cm) and the depth of said casing slot perpendicular to said outer face of said second wall portion is about 0.44 inch (1.12 cm).

* * * * *